US008035018B2

(12) United States Patent
Bausch, III

(10) Patent No.: US 8,035,018 B2
(45) Date of Patent: Oct. 11, 2011

(54) VERTICALLY VENTED DRUM SHELL

(75) Inventor: William J. Bausch, III, Wescosville, PA (US)

(73) Assignee: William J. Bausch, III, Allentown, PA (US)

( * ) Notice: Subject to any disclaimer, the term of this patent is extended or adjusted under 35 U.S.C. 154(b) by 0 days.

(21) Appl. No.: 12/611,537

(22) Filed: Nov. 3, 2009

(65) Prior Publication Data

US 2010/0107853 A1 May 6, 2010

Related U.S. Application Data

(60) Provisional application No. 61/111,898, filed on Nov. 6, 2008.

(51) Int. Cl.
*G10D 13/02* (2006.01)

(52) U.S. Cl. ..... 84/411 R

(58) Field of Classification Search ..... 84/411 R; 217/44, 89, 79
See application file for complete search history.

(56) References Cited

U.S. PATENT DOCUMENTS 578,198 A * 3/1897 Boulanger ..... 84/411 R
663,854 A * 12/1900 Boulanger ..... 84/411 R
885,371 A * 4/1908 Petracchi ..... 52/99
1,121,909 A * 12/1914 Elkins et al. ..... 84/411 R
1,328,587 A * 1/1920 Port ..... 217/44
1,341,060 A * 5/1920 Le Fevre et al. ..... 217/44
1,341,493 A * 5/1920 Bovee ..... 217/89
1,381,494 A * 6/1921 Olsen ..... 84/411 R
1,420,233 A * 6/1922 Baldwin et al. ..... 84/411 R
1,441,579 A * 1/1923 Hatcher ..... 217/44
1,475,897 A * 11/1923 Sutherland ..... 217/44
1,477,105 A * 12/1923 Brumfield ..... 217/44
1,775,224 A * 9/1930 Hoyt ..... 217/72
1,980,908 A * 11/1934 Cameron ..... 217/44
2,031,153 A * 2/1936 Fessenden ..... 217/76
2,048,667 A * 7/1936 Babcock ..... 217/12 A
2,292,545 A * 8/1942 Proctor ..... 242/118.61
2,470,459 A * 5/1949 Bell ..... 217/44
2,982,435 A * 5/1961 Moseley ..... 217/44
4,168,646 A * 9/1979 May ..... 84/723
4,300,437 A 11/1981 Hinger et al.
4,520,709 A * 6/1985 Kester, Jr. ..... 84/415
4,522,006 A * 6/1985 Plikuhn ..... 52/585.1
4,833,964 A * 5/1989 Prouty ..... 84/411 R
5,301,591 A * 4/1994 Greenberg ..... 84/411 R
6,057,499 A * 5/2000 Basmadjian ..... 84/411 R
6,927,330 B2 * 8/2005 May ..... 84/411 R
7,148,413 B2 * 12/2006 May ..... 84/411 R
7,446,250 B1 * 11/2008 van der Meulen ..... 84/411 R
7,485,791 B2 * 2/2009 Takegawa ..... 84/411 R
7,652,206 B2 * 1/2010 Okamoto ..... 84/411 R
7,692,082 B2 * 4/2010 Abe ..... 84/411 R
7,723,594 B2 * 5/2010 Hong ..... 84/412

(Continued)

*Primary Examiner* — Elvin G Enad
*Assistant Examiner* — Robert W Horn
(74) *Attorney, Agent, or Firm* — Norris McLaughlin & Marcus, P.A.

(57) ABSTRACT

A shell for a drum adapted to have at least one drum head fixedly secured thereto, includes at least one sidewall, a height and a plurality of flared vertical slots. The shell is comprised of a plurality of staves spaced from one another to create flared slots. The staves are of rectangular cross section. Each of the flared slots may be extends in length a major portion of the height of the drum shell. The flared slots may be non-linear or horizontally directed. Filler elements may be located within at least one of the slots.

5 Claims, 5 Drawing Sheets

U.S. PATENT DOCUMENTS 7,781,657 B2 * 8/2010 Nickel ..... 84/411 R
2006/0156898 A1 * 7/2006 Nickel ..... 84/411 R
2008/0223194 A1 * 9/2008 Okamoto ..... 84/411 R
2010/0107853 A1 * 5/2010 Bausch, III ..... 84/411 R

* cited by examiner

VERTICALLY VENTED DRUM SHELL

CROSS REFERENCE TO RELATED APPLICATION

This application claims the benefit of U.S. Provisional Patent Application No. 61/111,898, filed Nov. 6, 2008, the entirety of which is hereby incorporated by reference into this application.

BACKGROUND OF THE INVENTION

1. Field of the Invention

The present invention relates to musical instruments and, more particularly, to vented drum shells and method for constructing same.

2. Description of Related Art

In constructing drum shells, it is known to introduce openings through the drum shell, known as vents, in order to facilitate the escape of air and sound waves and to increase the volume from the drum. By decreasing the air pressure more quickly, the escape of air vents also facilitates the sympathetic vibration of the bottom drum head with the top drum head, thereby increasing the responsiveness and perceived volume of the drum. Traditional vents have been created by drilling or cutting holes into the side of a finished drum, or by constructing a split drum having separate top and bottom sections. These methods cause venting to be horizontal and/or irregular with respect to the grain of the wood which can form the shell and with respect to the sound waves created by the striking and resonance of the drum heads, which sound waves travel vertically within the column of the drum shell.

Known drum shells include those taught in: Sectionalized Musical Drum, U.S. Pat. No. 4,300,437, issued to Fred D. Hinger on Nov. 17, 1981, Drum With Modulated Acoustic Air Vent, issued to Randall L. May on Aug. 9, 2005, and Drum and Drum Body Formed From Adhered, Solid Blocks Of Wood issued to Keith A. Plikuhn on Jun. 11, 1985.

It would be desirable to have drum shells that provide improved venting throughout the air column within the shell, thereby further lessening sound wave phase cancellation while improving volume and response of the drum, and preserving the resonance of the shell material.

It would be desirable to have drum shell that could be constructed from pure wood, without the need for additional materials typically used in ply wood construction.

SUMMARY OF THE INVENTION

A new drum shell and drum is provided. The new drum shell design provides a unique sound and tonality. The inventive drum shell has a plurality of vertical vents, running substantial vertical length of the drum shell, which function to increase the volume and responsiveness of the drum by reducing air pressure throughout the vertical column inside the drum. One advantage of the new drum shell design is that it allows for the use of pure wood regardless of the desired thickness. The pure wood is not altered by other materials which are necessary in traditional drum shells to avoid cracking.

Traditional drums are created using a 2 and 3 layer plywood, which are molded to create a circle. The present invention is preferably constructed from a plurality of rectangular shaped vertical staves that are placed and secured in a circular pattern; the staves are spaced apart from each other to create vertical air vents in the drum shell between each stave. The vertical air vents allow for the release of compression and produce a distinctive resonance non typical of standard drum shell design. In addition to the acoustical advantages, the vertical air vents, rectangular wood pieces, and other components create an attractive and distinctive appearance.

A method of constructing a drum shell having a plurality of vertical vents is also provided. Other aspects of the invention will be apparent to those of ordinary skill in the art in view of the disclosure provided herein.

BRIEF DESCRIPTION OF THE DRAWINGS

The invention will be described in conjunction with the following drawings in which like reference numerals designate like elements. The skilled artisan will understand that the drawings, described below, are for illustration purposes only. The drawings are not intended to limit the scope of the present teachings in any way.

DETAILED DESCRIPTION

Figure 1:
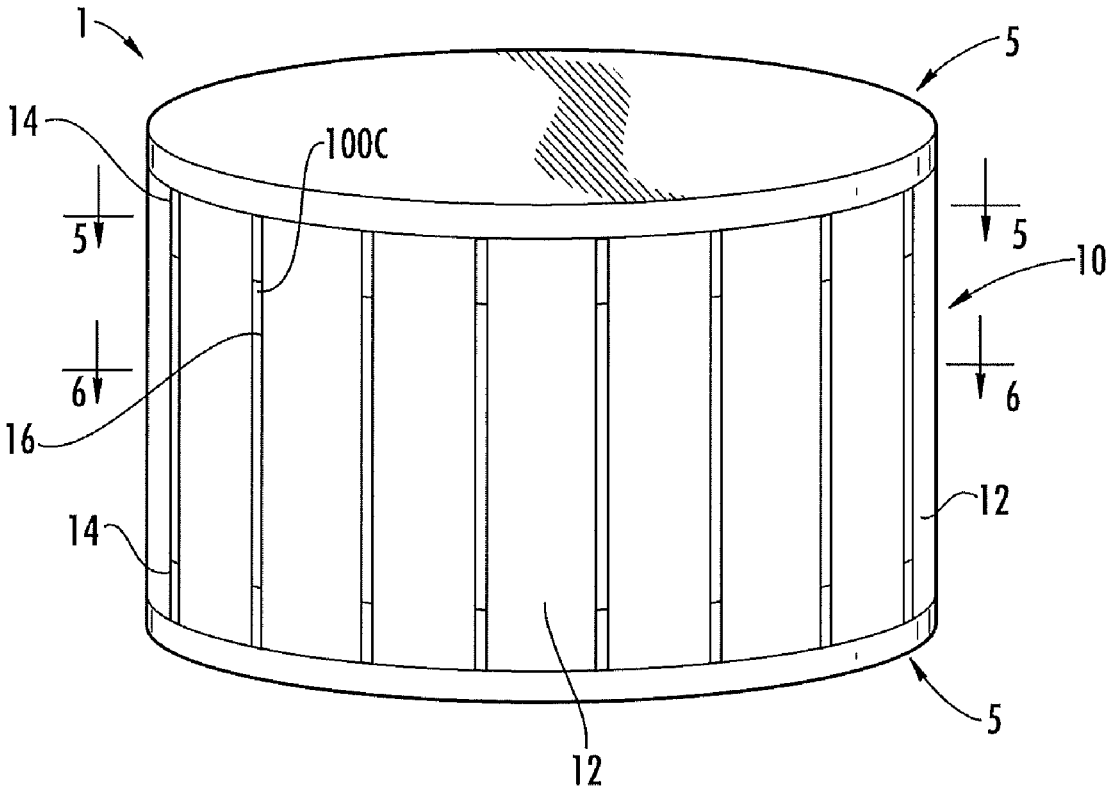
FIG. 1 is an isometric side view, showing a preferred embodiment of the stave-construction vertically vented drum shell of the present invention.

A vented drum shell 10 of a drum 1 is described. The vents of the drum shell 10 are substantially vertically oriented. As used herein, the vertical orientation of the vented drum shell 10 refers to the direction between the two opposing areas of the drum shell 10 receiving the drum heads 5. Similarly, the vertical dimensions refer to dimensions going in the direction from one drum head 5 to the other drum head 5. Therefore, with respect to certain drums, such as a bass drum, vertical vents 16 as described in detail below may visually appear to be horizontal when the drum 1 is set up to be played; however, as used herein, such vents are still vertical vents 16.

Referring to FIG. 1, vertical sections of staves 12 are arranged to form the circular shell of the drum shell 1. The material used in forming the staves 12 is preferably wood, such as red oak, maple, walnut, birch or any other kind of wood. However, other material may be used such as plastic, metal or composite or any other material from which staves 12 can be formed. A typical shell will have from about 10 to about 40 staves, although shells 1 may be constructed with any number of staves 12. The number of staves 12 will depend on certain factors such as the horizontal length of the staves 12 and the desired circumference of the finished shell 10. In one preferred embodiment, the number of staves 12 used is seventeen.

The plurality of staves 12 that make up the drum shell 1 are connected or secured to their adjacent staves 12 in a circular pattern. Although connected or secured, the staves 12 are not sealed together but rather are slightly separated or spaced apart from each other in order to form a vertical slot or vent 16 between each adjacent stave 12. In the preferred embodiment, staves 12 are separated by triangular wedges positioned between adjacent staves 12. In particular two triangular wedges 14—one arranged at or near the top of the staves 12 and one arranged at or near the bottom of the staves 12 are employed. Triangular wedges are preferably made of wood but other hard materials may be used so long as they supply enough support for the finished shell.

Figure 2:
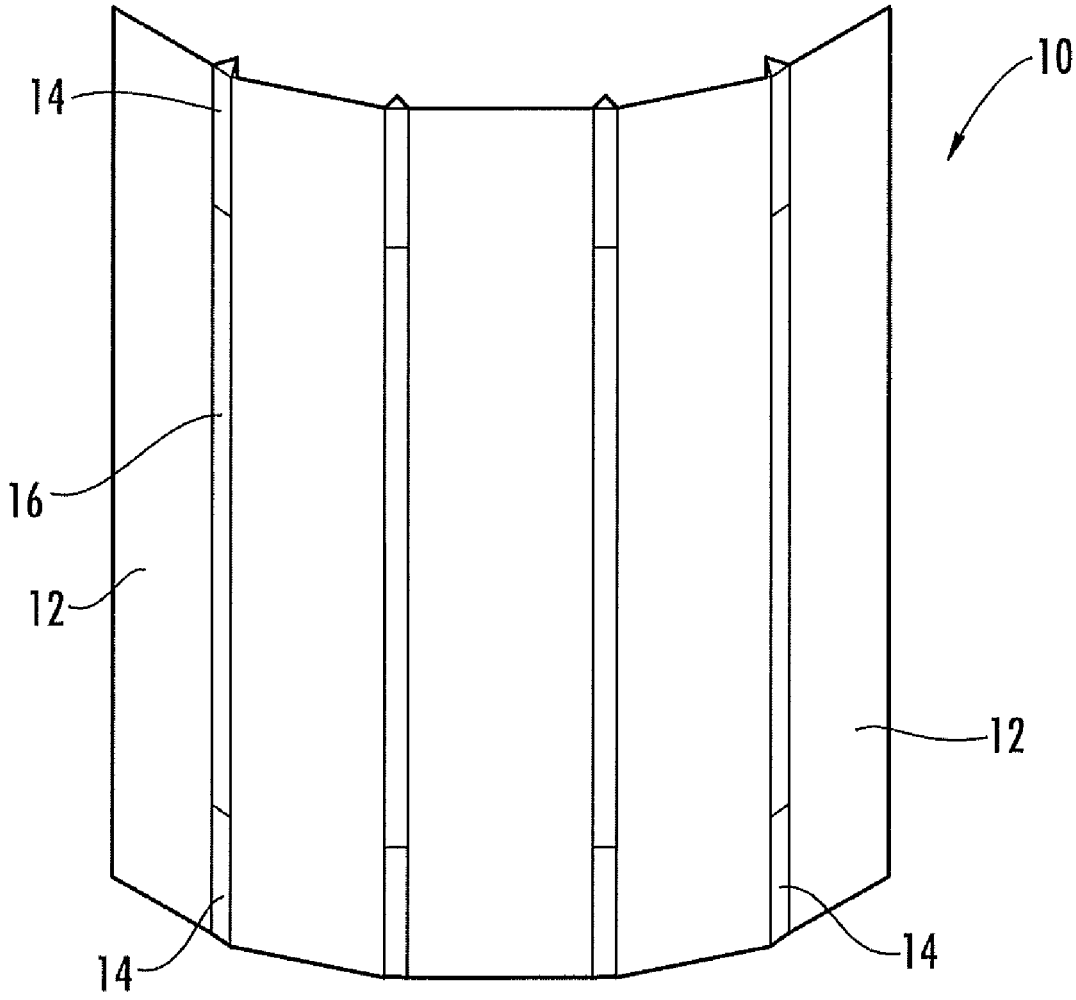
FIG. 2 is an isometric side view showing a partially assembled drum shell of the present invention.

A partially constructed shell 10 without a drum head 5 is shown in FIG. 2. The staves 12 are preferably glued to the wedges 14. Even more preferably, glue is applied to the wedge 14 and the staves are then secured to the wedge. The wedges 14 and staves 12 are pre-cut at the correct angles so that when all the staves 12 and wedges are assembled, a tight circle (i.e. the shell 10) is formed. Wedges 14 and staves 12 are preferably sanded smooth in order to ensure an airtight fit where the wedges 14 and staves 12 are in contact.

Once the shell 10 is completely assembled, the finished drum 1 is assembled using assembly techniques typically used with traditional shells. For example, drum lugs are attached to the drum shell via screws; tension rods attach drum the rim to drum lugs and the drum rim secures drum head to the actual shell.

Other means of separating or connecting the plurality of staves 12 may be used; non-limiting examples of which include non-triangular shaped separators, such as plugs, and separators that located at positions other than the top and bottom of the adjacent staves 12. For example, the wedges may be placed at various locations along the vertical vent so long as the vertical vent is not sealed.

Figure 3:
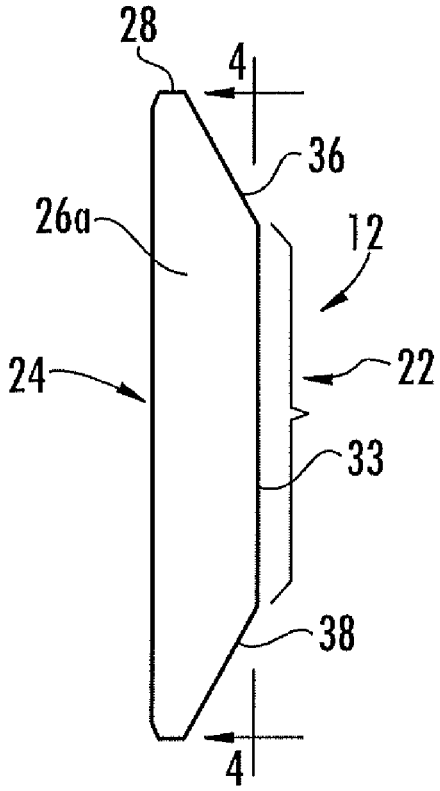
FIG. 3 is a side elevation view of a single stave of the drum shell of FIG. 1.
Figure 4:
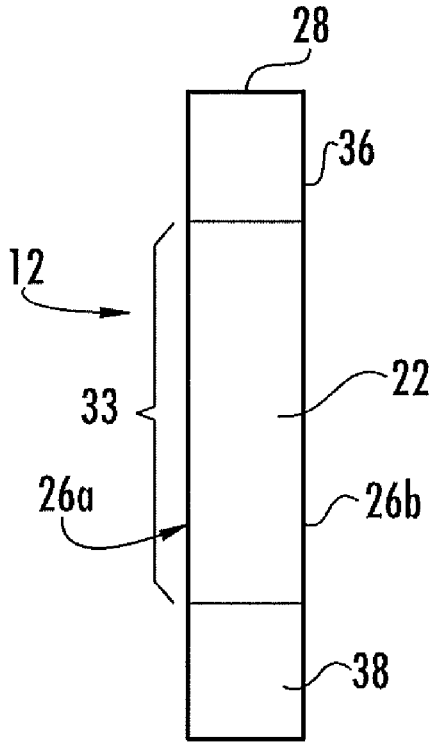
FIG. 4 is a rear view of a stave taken along Line 4-4 of FIG. 3.

FIGS. 3 and 4 illustrate two different views of a single stave 12 used in the invention. In the preferred embodiment, the stave 12 is rectangular in shape from the top view (best illustrated in FIGS. 5 and 6 for the cross-sectional view of the staves 12) with the four sides of the staves 12 at right angles to each adjacent face of the same stave 12. The four sides or faces of the stave 12 are referenced as follows according to their position in the assembled drum shell 10. The stave 12 has an inner face 22 that faces the inside of the assembled drum shell 10, an outer face 24 that faces the outside of the drum shell, and two sides 26*a* and 26*b* that face adjacent staves 12 in an assembled drum shell 10.

In the preferred embodiment, the top portion 36 and the bottom portion 38 of each stave 12, positioned above and below the center portion 33 respectively, of the inner face 22, is angled or beveled inwardly with respect to the center portion 33 to create a bearing edge for contacting the drum heads. Preferably, the top portion 36 and bottom portion 38 of the stave 12 retains a ledge or lip 28 that is not angled. The ledge 28 preferably extends inwardly from the outer face 24 at about a right angle and supports the drum head 5. Both the angle of the cut of the top portion 36 and bottom portion can be varied and will change the sound of the drum. Additionally the width of the ledge or lip 28 can be increased or decreased.

Figure 5:
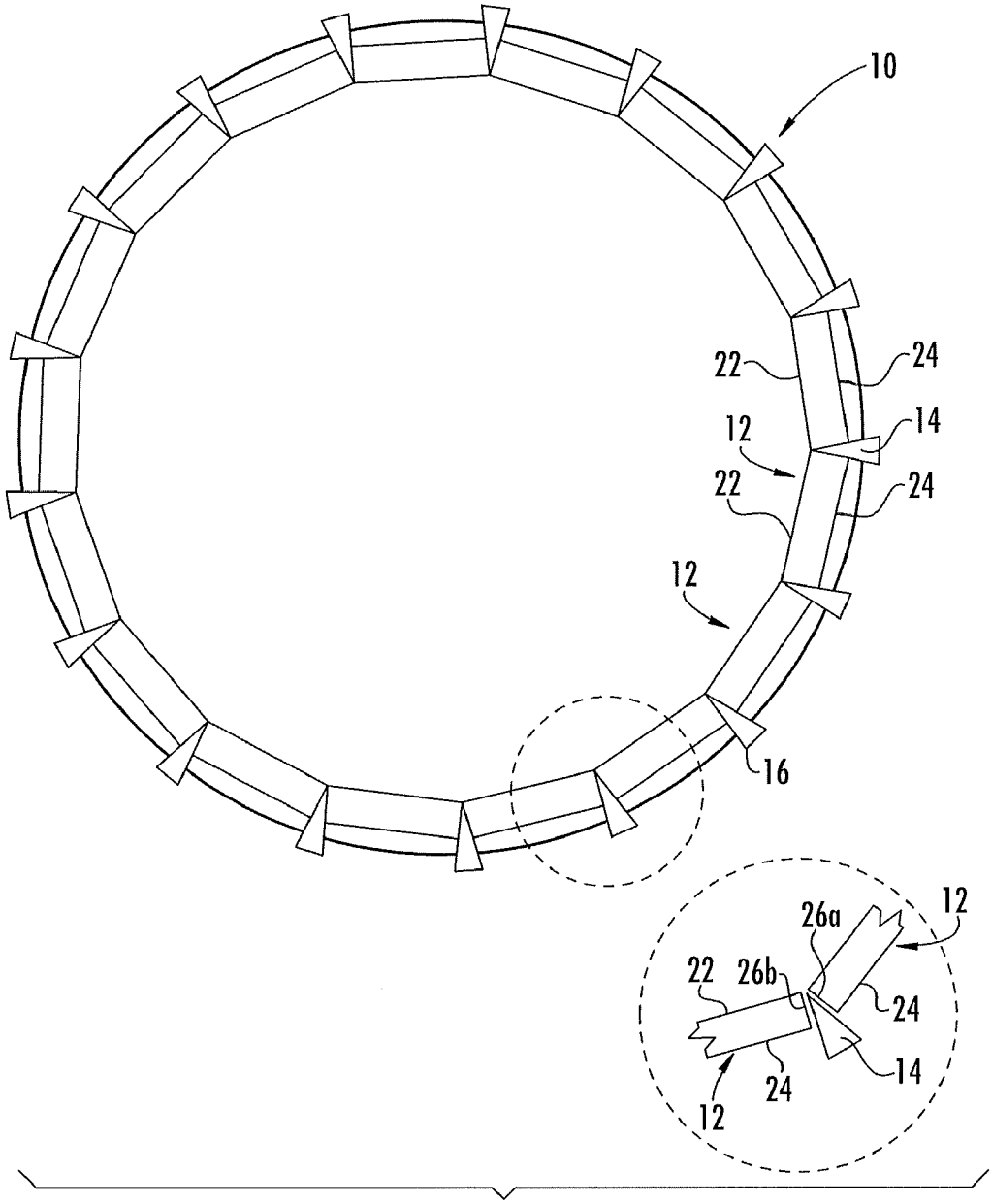
FIG. 5 is a sectional view taken along Line 5-5 of FIG. 1.

FIG. 5 shows a reduced sectional view taken along Line 5-5 of FIG. 1. This figure shows staves 12 having faces 22, 24, and 26*a* and 26*b* at right angles to each other and arranged in conjunction with triangular wedges 14 to form the circular drum shell 10 of a preferred embodiment. In one preferred embodiment the triangular wedges 14 protrude into the inner diameter of the drum shell 10, thereby adding support for the drum head, increasing head tension, and increasing the sensitivity of the drum head in response to striking by the drummer. In an alternate embodiment the triangular wedges 14 may alternatively be formed, cut, shaved, sanded off or otherwise trimmed or truncated to be arranged flush with the inner and/or outer faces of the adjoining staves 12. The wedges 14 are secured to the staves preferably using wood glue and braced or clamped together until the glue dries. Other methods of securing or attaching the wedges to the staves may be used.

Figure 6:
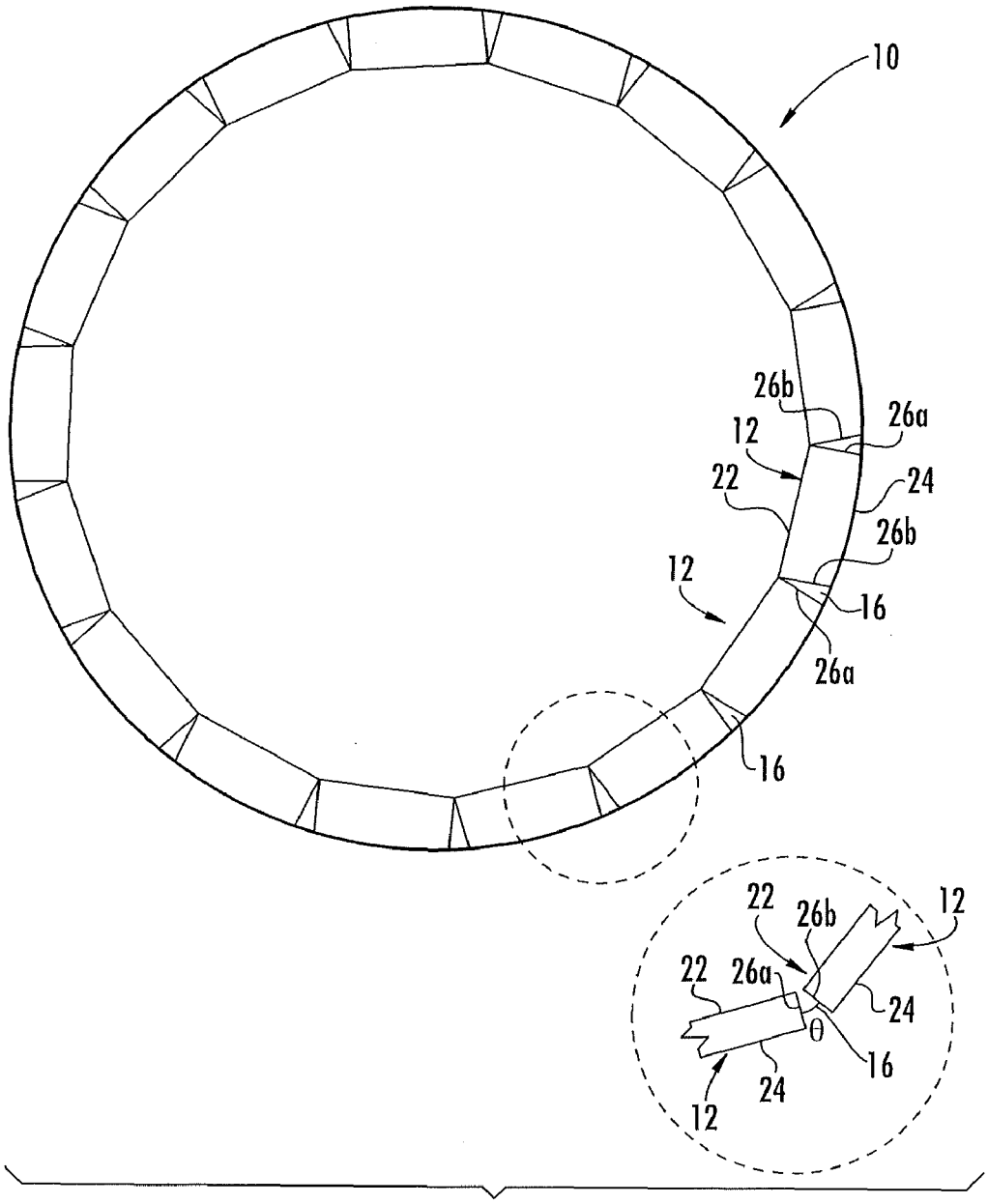
FIG. 6 is a sectional view taken along Line 6-6 of FIG. 1.

Referring to FIGS. 5 and 6, by combining the triangular wedges 14 with the right-angle staves 12, a vertical slot or vent 16 ("slot" and "vent" are used interchangeably unless otherwise noted) is created between adjacent staves 12. The vents 16 are arranged substantially vertically within the drum shell 10. FIG. 5 shows a cross section view of the assembled shell 10 with the wedges 14 in place; FIG. 6 shows the cross-sectional view of the shell with the staves 12 in place without showing the wedges 14. As illustrated in FIG. 6, the vertical vents 16 in the preferred embodiment are triangular shaped as a result of the rectangular shaped staves 12 and the triangular shaped wedges 14. A vertex 42 of the triangular vent 16 points toward the inner circumference of the drum shell 10 and the corresponding base 44 toward the outer circumference of the drum shell 10. FIG. 6 also shows a close up view of two adjacent staves illustrating that the adjacent staves 12 are not in contact but are positioned quite close together. For example, at the vertex, the side 26*a* and 26*b* may spaced apart from about 0.1 mm to about ¼ inch and may even be in light contact but will not be sealed. The exact spacing varies depending on size of assembled shell 10 and the desired tonality.

The adjacent staves 12 are positioned at an angle θ to each other thereby creating a triangular shape along the sides 26*a* and 26*b*. As the sides 26*a* and 26*b* of the two adjacent staves are the same dimensions, a vent 16 in the shape of an isosceles triangle is formed. However, in alternate embodiments, the shapes of the staves 12 from the top view need not be rectangular or even at right angles. For one example, the staves 12 may be trapezoidal in shape in which the outer sides 24 are longer (or shorter) than the inner sides, thereby creating a vent with a triangle with a different vertex angle θ (and wider or narrower flared vent). For another example, the outer face 24 or inner face 22, or both can be curved as opposed to straight.

The degree of flaring of the vertical vents 16 can be varied by changing the angle θ of the vents 16. This can be manipulated a variety of ways. For example, the number of staves 12 can be increased without changing the circumference thereby lowering the angle θ between adjacent staves (or alternatively decreased thereby increasing the angle θ). The cross-sectional shape of the staves 12 can be changed from right angles to larger angles for increased flaring or smaller angles for decreased flaring. While it is preferred that the wedges 14 are positioned at or near the top and bottom, the wedges 14 can be positioned in other locations. In addition, the vents 16 can have filler elements located inside them. Filler elements can provide additional strength to the drum but the vent cannot be entirely sealed.

This triangular vent 16 serves to increase the volume of the drum by acting as a horn, thereby projecting the sound of the drum outward. The vertical vent 16 further serves to facilitate the escape of air from the drum throughout the drum shell 10, thereby preserving the sympathetic resonance of the opposing heads and reducing sound wave phase cancellation inside the drum. Alternative embodiments may include trapezoidal staves 12 in which the outer face of the stave 12 is larger than the inner face, combined with wedges 14 that cause the alignment of the staves 12 to create the vertical vents 16. The preferred angle for the angle θ 18 to 30 degrees, but may vary depending on shell size but the angle may be greater or smaller depending on the number of staves used.

In another alternative embodiment, the vertical vents 16 may be cut or routed at equal intervals into a non-stave drum shell 10 such as a steam-bent, solid drum shell 10, or ply construction drum shell 10.

As shown in FIGS. 1 and 2, the vertical vents 16, have a height that extends substantially parallel to the longitudinal axis of the drum shell 10. The vertical vents 16 have sidewalls which, in the preferred embodiment, are created by the sides

26*a* and 26*b* of two adjacent staves 12. Therefore, the vertical vents 14 of the preferred embodiment extend in a substantially linear direction as the sides 26*a* and 26*b* are planar and are at right angles to the top 28 surface that secures the drumhead 5.

In alternative embodiments, the vertical vents, the stave arrangement and the wedge shape and arrangement may all be varied while still producing a drum shell with vertical vents. For example, the vertical vents 14 may be non-linear and/or non-planar as a result of changing the dimensions of the staves 12. Similarly, the cross section of the vents may be changed to a different shape. Non-limiting examples of alternative embodiments include vents 16 that extend vertically (i.e. from one drum head to the other) but not in a direction that is perpendicular to the drumhead, such as serpentine, wave, or diagonal in direction. For another example, otherwise irregularly shaped vertical vents may be included such as those formed by cutting or routing of a solid drum shell.

The stave arrangement may also be altered. For one example, the shell may be constructed of two sets of small staves set on top of each other to create a shell a larger shell. The vertical vents from each shell may be stacked in line or staggered such that the vents do not line up. For another example, the staves may be arranged in a double shell inlay pattern in which two thin stave shells are made and one shell is set inside the larger shell.

It should be further understood that the dimensions shown in FIGS. 1-5 are illustrative and not to scale and the invention is not limited to those exact dimensions.

While the invention has been described in detail and with reference to specific examples thereof, it will be apparent to one skilled in the art that various changes and modifications can be made therein without departing from the spirit and scope thereof.

Method for Constructing a Stave Drum

The following method is one method for constructing a stave drum shell in accordance with the invention. The process starts by drawing a diagram of a circle of desired size (e.g. 10 inch, 12 inch, 22 inch—inner circumference). A drum head may be used as a guide or alternatively a drawing tool or CAD program may be used. The diagram is utilized as a guide and template in the construction of the drum shell.

The depth, width and length of each cut rectangular piece (stave) vary depending on the desired dimensions of the assembled drum shell. Using the diagram as a guide, the width and depth is drawn on the inside of circle diagram. The amount of rectangular pieces of wood and angle wedges needed is identified from the drawing, and the pieces are cut.

When all cut rectangular pieces are complete, angle wedges are cut from the top and bottom of each individual piece. Wedges cut from rectangular pieces are cut in such a way to create a lip or ledge to support the drumhead. The angle will also allow sound waves to resonate though air compression vents/wood to create unique sound and release air compression inside of drum and the specific angle chosen can be varied to produce different sounds. Sides of rectangular pieces should be sanded to create a tight fit between the rectangular pieces and the wedge to which it is being secured. It is important to have a tight fit between the staves and the wedges as a loose or uneven fit can alter or distort the sound quality escaping through the vents.

Using the diagram as a guide, place two staves together at the required angle. Insert angle wedges on the outer top and bottom of rectangular pieces with glue. A level and canters square are used to square up the components accurately. Tightly secure pieces for proper bonding and allow drying time. Repeat this process for the entire circumference to create the shell of the drum. Circumference should reflect original desired size of diagram. Filler may be used in air compression vents for stronger bond and to alter sound/tonality.

Any portion of the wedges exposed around entire outer shell (top and bottom) can be removed using a saw or other removal tool. Wedges exposed on top inner shell may be removed or cut/sanded on an angle so as not to negatively effect the application of the drum head. Alternatively, the top wedge sections may also be left in place to create added tension and response on the drum head. Removal and or sanding of wedges can alter sound or tonality of drum so that should be considered prior to doing either.

The entire exterior of the assembled drum shell can be sanded to create a circular top and bottom of shell. Top and bottom "rims" can be created by sanding towards the inside of drum to create a "lip" or rounded edge. Top and bottom rim should be level to ensure that the drum head properly sits and seals against the lip. Improper sealing of the drum head negatively affects sound and tonality, compression and stick response on drumhead.

Holes may be drilled through shell for the desired placement of drum hardware. Optionally, the drum may be finished with fine grit sanding and application of desired staining and lacquer. Additionally, engraving or carving may also be applied as art for appearance purposes.

While the invention has been described in detail and with reference to specific examples thereof, it will be apparent to one skilled in the art that various changes and modifications can be made therein without departing from the spirit and scope thereof. For example, in other embodiments, any number of vertically spaced apart wedges can be provided within a vent 16 or slot 16. For example, a single wedge 14 extending the entire vertical length of the slot 16 can be used. Additionally, a number of horizontally adjacent wedges 17 can be located in the slots.

What is claimed is:

1. A shell for a drum, said shell adapted to have at least one drum head fixedly secured thereto, comprising:

at least one sidewall a plurality of vertical slots that extend through the sidewall, each vertical slot extending in a direction that is substantially perpendicular to the drum head, wherein said shell is comprised of a plurality of staves spaced from one another and dimensioned to create triangular shaped vertical slots and said staves have a rectangular cross section throughout the stave and wherein the staves are separated by at least one wedge between adjacent staves.

2. The drum shell of claim 1 wherein the tips of said triangular wedges protrude into the inner area of said drum shell.

3. The triangular wedges of claim 2 wherein said wedges are arranged at a vertical position relative to said drum shell such that said wedges are flush with the top and bottom of said drum shell.

4. The drum shell of claim 1 wherein said triangular wedges are cut, sanded or otherwise truncated so that no portion of said triangular wedges contacts a drum head when said drum head is seated on said drum shell.

5. A drum comprising a drum shell; and drum heads at the top and bottom of the drum shell, wherein the drum shell has a plurality of vertically arranged air vents, said air vents extending in the direction of one drum head towards the opposite drum head, wherein said drum shell is constructed of a plurality of staves, wherein the faces of each stave are arranged at right angles to each adjacent face and space between said staves creates said vertically arranged air vents and wherein said staves are connected by two triangular wedges, one of said triangular wedges arranged at or near the top of said drum shell and the other of said triangular wedges arranged at or near the bottom of said drum shell.

* * * * *